US005999921A

United States Patent [19]

Arsenault et al.

[11] Patent Number: 5,999,921

[45] Date of Patent: Dec. 7, 1999

[54] ELECTRONIC POSTAGE METER SYSTEM HAVING PLURAL CLOCK SYSTEM PROVIDING ENHANCED SECURITY

[75] Inventors: Robert Arsenault, Stratford; William Bailey, Guilford; Craig DeFilippo, Milford, all of Conn.

[73] Assignee: Pitney Bowes Inc., Stamford, Conn.

[21] Appl. No.: 08/846,646

[22] Filed: Apr. 30, 1997

[51] Int. Cl.[6] ..... G07B 17/00

[52] U.S. Cl. ..... 705/410; 364/528.41; 968/817

[58] Field of Search ..... 364/528.41; 380/49; 705/400, 408, 410; 968/817

[56] References Cited

U.S. PATENT DOCUMENTS

| | | | |
|---|---|---|---|
| 3,978,457 | 8/1976 | Check, Jr. et al. | 340/172.5 |
| 4,122,526 | 10/1978 | Dlugos et al. | 364/705 |
| 4,168,533 | 9/1979 | Schwartz | 364/900 |
| 4,301,507 | 11/1981 | Soderberg et al. | 364/464 |
| 4,323,767 | 4/1982 | Yoshida | 377/54 |
| 4,493,252 | 1/1985 | Clark | 101/71 |
| 4,535,419 | 8/1985 | Dlugos et al. | 364/900 |
| 4,579,054 | 4/1986 | Buan et al. | 101/91 |
| 4,725,718 | 2/1988 | Sansone et al. | 235/495 |
| 4,757,537 | 7/1988 | Edelmann et al. | 380/51 |
| 4,775,246 | 10/1988 | Edelmann et al. | 380/23 |
| 4,796,193 | 1/1989 | Pitchenik | 364/464.02 |
| 4,802,218 | 1/1989 | Wright et al. | 380/23 |
| 4,812,994 | 3/1989 | Taylor et al. | 364/464.02 |
| 4,813,912 | 3/1989 | Chickneas et al. | 364/464.02 |
| 4,831,555 | 5/1989 | Sansone et al. | 364/519 |
| 4,853,523 | 8/1989 | Talmadge | 235/492 |
| 4,858,138 | 8/1989 | Talmadge | 364/464.02 |
| 4,907,271 | 3/1990 | Gilham | 380/25 |
| 4,980,542 | 12/1990 | Jackson et al. | 235/375 |
| 5,051,564 | 9/1991 | Schmidt | 235/381 |
| 5,065,000 | 11/1991 | Pusic | 235/381 |
| 5,111,030 | 5/1992 | Brasington et al. | 235/375 |
| 5,237,506 | 8/1993 | Horbal et al. | 364/464.02 |
| 5,293,319 | 3/1994 | DeSha et al. | 364/464.02 |
| 5,309,363 | 5/1994 | Graves et al. | 364/464.02 |
| 5,319,562 | 6/1994 | Whitehouse | 364/464.03 |
| 5,319,581 | 6/1994 | Sakata et al. | 364/705.07 |
| 5,367,464 | 11/1994 | Abumehdi et al. | 364/464.02 |
| 5,375,172 | 12/1994 | Chrosny | 380/51 |
| 5,390,251 | 2/1995 | Pastor et al. | 380/21 |
| 5,440,108 | 8/1995 | Tran et al. | 235/381 |
| 5,457,642 | 10/1995 | Brookner | 177/25.15 |
| 5,483,458 | 1/1996 | Lee et al. | 364/464.02 |
| 5,490,077 | 2/1996 | Freytag | 235/375 X |
| 5,508,933 | 4/1996 | Abumehdi | 705/408 |
| 5,572,706 | 11/1996 | Matsumoto | 711/167 |
| 5,613,007 | 3/1997 | Balga, Jr. | 380/51 |
| 5,625,692 | 4/1997 | Herzberg et al. | 380/21 |
| 5,657,689 | 8/1997 | Lee | 101/91 |
| 5,724,425 | 3/1998 | Chang et al. | 380/25 |
| 5,842,187 | 11/1998 | Williams | 705/412 |
| 5,933,625 | 8/1999 | Sugiyama | 713/503 |

FOREIGN PATENT DOCUMENTS

| | | |
|---|---|---|
| 0621562 | 10/1994 | European Pat. Off. . |
| 0 665 517 | 1/1995 | European Pat. Off. . |
| 0725 371 | 1/1996 | European Pat. Off. . |
| 44 22 263 | 6/1994 | Germany . |

OTHER PUBLICATIONS

Information Based Indicium Program dated Jun. 13, 1996.
Information Based Indicia Program Postal Security Device Specification dated Jun. 13, 1996.

*Primary Examiner*—Edward R. Cosimano
*Attorney, Agent, or Firm*—Steven J. Shapiro; Melvin J. Scolnick

[57] ABSTRACT

A system includes a system time counter associated with a micro controller and a secure clock module having a real time clock and an elapsed time counter. The system synchronizes operation between the secure clock module and the system time counter. The synchronized time entered into the system time counter is utilized in the operation of the system. The real time clock time can be caused to be entered into the elapsed time counter at certain point in the operation of the system. The relationship of the time provide enhanced systems security.

10 Claims, 4 Drawing Sheets

( MFG TIME SETTING )

( CALCULATE " GEM TIME" SUBROUTINE )

( POWER UP SEQUENCE )

(" SLEEP " ACTIVITY )

(" MIDNIGHT " ACTIVITY )

(" WAKE UP " ACTIVITY )

ELECTRONIC POSTAGE METER SYSTEM HAVING PLURAL CLOCK SYSTEM PROVIDING ENHANCED SECURITY

FIELD OF THE INVENTION

The present invention relates to systems with secure clocks more particularly, to a clock system for enhancing security in a value metering system such as a postage metering system.

BACKGROUND OF THE INVENTION

Electronic postage metering systems have been developed which include both a single printing arrangement associated with a single accounting arrangement. These printing and accounting systems have been usually housed in a single secure housing to provide for protection against tampering to provide for security. Other types of electronic postage metering systems have involved the utilization of portable detachably connectable accounting systems such as smart cards and other portable type devices.

These postage meter systems involve both prepayment of postal charges by the mailer (prior to postage value imprinting) and post payment of postal charges by the mailer (subsequent to postage value imprinting). Prepayment meters employ descending registers for securely storing value within the meter prior to printing, while post payment (current account) meters employ ascending registers to account for value imprinted. Postal charges or other terms referring to postal or postage meter or meter system as used herein should be understood to mean charges, meters or systems, for either postal charges, tax charges, private carrier charges, tax service or private carrier service, as the case may be, and other value metering systems, such as certificate metering systems such as is disclosed in U.S. Pat. No. 5,796,841 for SECURE USER CERTIFICATION FOR ELECTRONIC COMMERCE EMPLOYING VALUE METERING SYSTEM, issued Aug. 18, 1998.

Postage metering systems have also been developed which employ encrypted information on a mailpiece. The postage value for a mailpiece may be encrypted together with the other data to generate a digital token. A digital token is encrypted information that authenticates the information imprinted on a mailpiece such as postage value. Examples of postage metering systems which generate and employ digital tokens are described in U.S. Pat. No. 4,757,537 for SYSTEM FOR DETECTING UNACCOUNTED FOR PRINTING IN A VALUE PRINTING SYSTEM, issued Jul. 12, 1988; U.S. Pat. No. 4,831,555 for SECURE POSTAGE APPLYING SYSTEM, issued May 15, 1989; U.S. Pat. No. 4,775,246 for SYSTEM FOR DETECTING UNACCOUNTED FOR PRINTING IN A VALUE PRINTING SYSTEM, issued Oct. 4, 1988; U.S. Pat. No. 4.725,718 for POSTAGE AND MAILING INFORMATION APPLYING SYSTEMS, issued Feb. 16, 1988. These systems, which may utilize a device termed a Postage Evidencing Device (PED) or Postal Security Device (PSD), employ an encryption algorithm which is utilized to encrypt selected information to generate the digital token. The encryption of the information provides security to prevent altering of the printed information in a manner such that any change in a postal revenue block is detectable by appropriate verification procedures.

Encryption systems have also been proposed where accounting for postage payment occurs at a time subsequent to the printing of the postage. Systems of this type are disclosed in U.S. Pat. No. 4,796,193 for POSTAGE PAYMENT SYSTEM FOR ACCOUNTING FOR POSTAGE PAYMENT OCCURS AT A TIME SUBSEQUENT TO THE PRINTING OF THE POSTAGE AND EMPLOYING A VISUAL MARKING IMPRINTED ON THE MAILPIECE TO SHOW THAT ACCOUNTING HAS OCCURRED, issued Jan. 3, 1989; U.S. Pat. No. 5,293,319 for POSTAGE METERING SYSTEM, issued Mar. 8, 1994; and, U.S. Pat. No. 5,375,172, for POSTAGE PAYMENT SYSTEM EMPLOYING ENCRYPTION TECHNIQUES AND ACCOUNTING FOR POSTAGE PAYMENT AT A TIME SUBSEQUENT TO THE PRINTING OF THE POSTAGE, issued Dec. 20, 1994.

Other postage payment systems have been developed not employing encryption. Such a system is described in U.S. Pat. No. 5,319,562 for SYSTEM AND METHOD FOR PURCHASE AND APPLICATION OF POSTAGE USING PERSONAL COMPUTER, issued Feb. 21, 1995. This patent describes a system where end-user computers each include a modem for communicating with a computer and a postal authority. The system is operated under control of a postage meter program which causes communications with the postal authority to purchase postage and updates the contents of the secure non-volatile memory. The postage printing program assigns a unique serial number to every printed envelope and label, where the unique serial number includes a meter identifier unique to that end user. The postage printing program of the user directly controls the printer so as to prevent end users from printing more that one copy of any envelope or label with the same serial number. The patent suggests that by capturing and storing the serial numbers on all mailpieces, and then periodically processing the information, the postal service can detect fraudulent duplication of envelopes or labels. In this system, funds are accounted for by and at the mailer site. The mailer creates and issues the unique serial number which is not submitted to the postal service prior to mail entering the postal service mail processing stream. Moreover, no assistance is provided to enhance the deliverability of the mail beyond current existing systems.

Recently, the United States Postal Service has published proposed draft specifications for future postage payment systems, including the Information Based Indicium Program (IBIP) Indicium Specification dated Jun. 13, 1996; the Information Based Indicia Program Postal Security Device Specification dated Jun. 13, 1996; and, the Host Specification dated Oct. 9, 1996. These are Specifications disclosing various postage payment techniques including various types secure accounting systems that may be employed, as for example, a single chip module, multi chip module, and multi chip stand alone module (See for example, Table 4.6-1 PSD Physical Security Requirements, Page 4-4 of the Information Based Indicia Program Postal Security Device Specification).

In the above identified information based indicium program, the United States Postal Service has specified particular inspection periods which must be implemented for a personal security device or metering type device to remain in service. For such a system to have a high level of security, it is desirable to incorporate a secure clock which is inaccessible by the user so that the unit may not be maintained in operation beyond the inspection expiration date. In systems of this type, the clock may be used to disable operation or disable certain operations of the personal security device. Additionally, another critical function of secure clocks that may be employed in an encrypted indicia type of system is the utilization of the date and time (or portions thereof as part of the encrypted indicia which may be used in verification to insure the validity of the imprint. In such a case, the secure clock, among other functions, provides a changing time which precludes the same personal security device from printing two encrypted indicias having the exact same attributes. This facilitates detection of fraudulent copies of indicias.

Additionally, other enhanced functionalities are obtained by utilization of a secure clock. For example, maintenance cycles can be assured as being initiated within predetermined periods of time since the secure clock may not be altered by the user or service personnel, except under controlled conditions.

SUMMARY OF THE INVENTION

It has been discovered that the utilization of a plural clock system can enhance the security where a secure clock is desirable.

It has also been discovered that a clock module can be employed as a time synchronizer for other circuitry in the system in a value metering system.

It is an object of the present invention to employ plural clocks to allow one clock to be utilized as a time synchronizer which operates with a second clock to validate each other.

It is also an object of the present invention to enable different clock software routines to be used to convert different time keeping arrangements to provide system time computability.

It is still another object of the present invention to have a two clock system which provides the ability to upgrade to higher level of security system than a system which employ single clock time keeping systems.

It is a further object of the present invention to provide a clock system which utilizes a synchronizer clock to synchronize circuitry in a system requiring a secure clock arrangement.

It is yet another object of the present invention to provide a secure clock system for a value metering system, as for example, one which generates encrypted signals.

Additionally, it is yet another objective of the present invention to eliminate separate replaceable batteries in a metering system employing a clock system.

It is also a further object of the present invention to provide a clock system that employs a real time clock (or counter) and an elapsed time clock (or counter) in a way to provide a clock system where the two timers are synchronized at particular points in a value metering system operation.

It is also a further object of the present invention to provide a clock system that employs a real time clock (or counter) and an elapsed time clock (or counter) in a way to provide a clock system where the time or count in each of the two timers are employed at particular points in a value metering system operation to provide enhanced reliability and/or security.

It is still a further object of the present invention to provide a reliable, non-user accessible, secure clock system for various purposes such as initiating ink jet print maintenance routines or in generating encrypted indicia.

A system embodying the present invention includes a micro controller having a system time counter; a secure clock module is connected to a micro controller. Means interconnecting the secure clock module and the system time counter to provide a predetermined relationship between the system time counter and the secure clock module.

In accordance with an aspect of the present invention a clock system includes a real time clock for maintaining a real clock time and an elapsed time clock having an elapse time storable therein. Means store the real clock time into the elapsed time clock storage.

In accordance with another aspect of the present invention, a method of providing a system clock time includes reading an elapsed time clock and reading a real time clock and storing the real time clock time in the elapsed time clock if the elapsed time clock has a predetermined relation to the real time clock.

BRIEF DESCRIPTION OF THE DRAWINGS

Reference is now made to the following figures wherein like reference numerals designate similar elements in the various views and in which.

DETAILED DESCRIPTION OF THE PREFERRED EMBODIMENT

Figure 1:
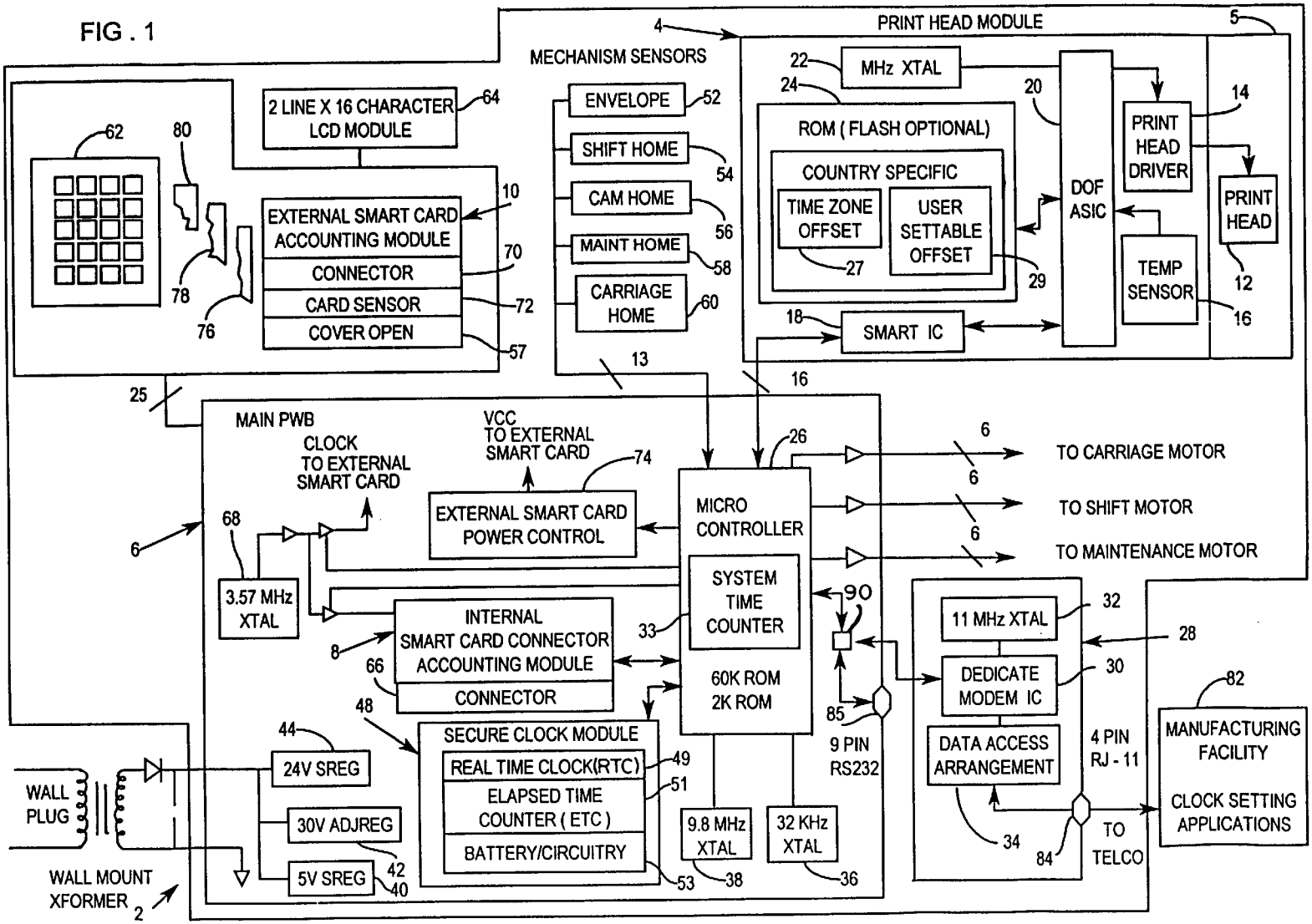
FIG. 1 is a schematic diagram of a value metering system embodying the present invention.

Reference is now made to FIG. 1. Certain aspects of the metering system structure and organization shown in FIG. 1 are shown and described in copending U.S. patent application Ser. No. 08/703,312 filed Aug. 23, 1996, for ELECTRONIC POSTAGE METER SYSTEM SEPARABLE PRINTING AND ACCOUNTING ARRANGEMENT INCORPORATING PARTITION OF INDICIA AND ACCOUNTING INFORMATION, assigned to Pitney Bowes Inc., the entire disclosure of which is hereby incorporated by reference.

A value metering system is an electronic postage meter system shown generally at 2, includes a removable printhead module 4 within a housing 5, a base module 6 and a secure internal accounting system module 8 and an external secure accounting system module 10 which will be hereafter explained in greater detail. The accounting systems include an internal accounting systems 8 and an external accounting system 10. These accounting systems account for the operation of the metering system and for the printing of postage value. Separate secure housings may be provided for protecting the accounting system, and protecting the secure clock module 48. A single secure housing or other housing arrangement may able be utilized to provide physical security and/or prevent of tampering The print module 4 includes a printhead 12 which may be an ink jet printhead or other variable printing means. A printhead driver 14 provides the necessary signals and voltages to the printhead. A temperature sensor 16 is used to sense the ambient temperature. Since ambient temperature changes the viscosity of the printhead ink, this information enables change of the signals and voltages to the printhead to maintain a constant drop size.

A smart card chip 18 which contains internal nonvolatile storage receives encrypted command and control signals from the base unit 6 and provides information to the ASIC 20 to operate the printhead driver 14. The ASIC 20 may be of the type described in U.S. Pat. No. 5,651,103 for MAIL HANDLING APPARATUS AND PROCESS FOR PRINTING AN IMAGE COLUMN-BY-COLUMN IN REAL TIME, issued Jul. 22, 1997, the entire disclosure of which is hereby incorporated by reference. The ASIC 20 is connected to a crystal clock 22 and obtains the necessary operating program information from a ROM or flash memory 24 so as to appropriately control the sequence of the information to the ink printhead driver 24 such that the printhead 12 produces a valid and properly imprinted indicia (which herein is meant to include a digital token in whatever format it is to be imprinted).

The base module 6 includes a micro controller 26 which is connected to operate the electronic postage meter system motors and display and is coupled to the various accounting systems. The micro controller 26 is connected to a modem 28 which includes a modem chip 30 connected to a crystal clock 32 and a data access arrangement 34 for enabling modem communications between the metering system 2 and external systems.

An RS 232 port 85 is provided. The RS 232 port 85 is connected to the micro controller 26 via a switch 90 which is operated under the control of the micro controller 26 such that either the RS 232 port 27 is enabled or the modem 28 is enabled. Should the RS 232 port 27 be enabled, the port may be used for communicating with the metering system by way of modem, direct connection or other serial communication technique suitable for RS 232 communications.

The micro controller 26 additionally provides various control signals to operate the meter system including signals to the printhead carriage motor, the printhead shift motor and the printhead maintenance motor which are utilized to move position and maintain the printhead 12. The micro controller 26 is operated under control of two separate crystal clocks 36 and 38. The higher frequency 9.8 megahertz crystal clock is used when the electronic meter system is in active operation and the lower speed 32 kilohertz crystal clock 36 is used when the meter is in a "sleep mode" and the display is blanked and the system is in a quiescent state.

Various power is provided to the micro computer and to the electronic postage meter system including a 5 volt regulated power supply 40, a 30 volt adjustable power supply 42, and a 24 volt regulated power supply 44.

Various electronic postage meter sensors are connected to the micro controller 26 including envelope sensor 52 which senses the presence of an envelope in the envelope slot of the metering system, shift home sensor 54, which senses the home position of the shift motor (Y motor), a cam home sensor 56, and a cover open sensor 57, a maint home sensor 58 and a carriage home sensor 60.

The micro controller 26 is additionally connected to a key pad 62 and an LCD Display Module 64. This enables a user to enter data into the metering system to view information show in the display 64.

The metering system 2 employs two accounting systems. The first accounting system, referred to above as the secure internal account system module 8, involves an internal smart card (or smart card chip) and the second accounting system, referring to above as the external secure accounting system module 10, involves an external smart card. These smart cards are micro processor based devices which each provide for secure metering functionality. These smart card accounting systems or smart card vault systems securely maintain various registers associated with the metering system and provide the meter accounting functionality. Additionally, the accounting systems provide for the capability of communicating register information and postage refilling and removal information to add or remove value from the various accounting registers. Each of the secure accounting systems generate the indicia and/or digital tokens needed to be imprinted on a mailpiece by the printhead 12. Additionally, the modules provide for encrypted communications into and out of the accounting system such as may be associated with the funds refilling or funds debiting function. For the particular embodiment shown, the accounting system provides for authentication of the printhead module smart card 18 and the accounting system. Whenever there is a request by a user through the keypad 62 or otherwise, to print postage, or whenever else it is desired, a mutual authentication occurs. The accounting system authenticates that it is in communication with a printhead module smart card chip 18, each authenticating the other as being authentic and valid metering systems. Thereafter encrypted communications are enabled between the active secure accounting system and the smart card chip 18 which is part of the printing system to provide security that the messages are authorized uncorrupted messages. This may be by way of a cryptographic certificate.

The metering system 2 provides added functionality and capability to the system by the employment of the two separate accounting systems 8 and 10. The internal smart card accounting system 8 is connected to the micro controller 26 via a plug connector 66. This facilitates removal of the internal smart card 8 should external inspection be required where the device is inoperative. A 3.57 megahertz crystal clock 68 is connected to the smart card 8 and to the micro controller 26. Additionally, the clock 68 is connected to the external smart card 10 via the external smart card plug connector 70. The micro controller provides a smart card sensor switch 72 which detects the presence or absence of the external smart card 10. When the external smart card is detected as being present, the switch is connected to the micro controller 26 via the connector cable 74 causing the micro controller 26 to enable the external smart card power control circuitry 74 to apply power to the external smart card and gates the crystal clock 68 to provide clock signals to the external smart card 10, both via the smart card connector 70.

It should be expressly noted that the system is configured such that it may be a system operated with both the internal accounting system 8 and an external accounting system 10, or with only the internal accounting system 8 or with only the external accounting system 10. Moreover the external smart card 10 is arranged so that it can be connected to other electronic metering systems and provides a portable means for a user to have postal funds available for imprinting on a mail piece or tape on other than a specific postage metering system. However, even when connected to a different electronic postage metering system the same authentication between the external smart card 10 and the print head smart card chip 18 occurs.

The system is designed with a priority arrangement. If no external secure accounting system, such as a smart card 10, is connected to the electronic postage meter system 2 the meter accounting functionality is provided by the internal secure accounting system smart card 8. This internal accounting system becomes the active accounting system for the metering system. However, if an external accounting system is connected into the system via the connector 70, the system will make the external accounting system, smart card 10, the active accounting system for the metering system 2.

Connector 70 is a flexible multi purpose connector. The connector 70 enables connections of other types of smart cards such as card 76, which contains ad slogan information (alpha numerics and/or graphic information), card 78, which contains rate table information, and smart card 80, which contains authentication code information. It should be recognized that when each of these cards 76, 78 or 80 is connected into the system via the multi-function connector 70 a self authentication process is effectuated between the smart card and the print module smart card chip 18 to ensure that valid cards and data are being employed. It may use the same encryption and/or cryptographic certificate techniques to ensure valid authentic and uncorrupted message communication. This system may be used for moving information and data into and out of the meter system 2.

The information of the type stored on cards 76, 78 and 80 are communicated from the card via the connector and the micro controller 26 to the smart card chip 18, the ASIC 20 and is stored in the flash memory 24 or the smart card chip 18 internal memory. For those embodiments which employ a ROM rather than a flash memory, the information is written into the print module smart card chip 18.

A refilling operation for the metering system 2 may be remotely implemented via the modem 28 or RS232 connector 85. A remote connection is established via the modem 28 or RS 232 connector 85 to a remote data center. This enables bidirectional communication between the data center via the modem 28 or connector 85 via the micro controller 26 to either the internal accounting system 8 and/or the external accounting system 10 and to the print module smart card chip 18. The system is configured such that if an external smart card 10 is connected to the system via connector 70, the communications will be with the external smart card and not the internal smart card chip 8. It should be expressly recognized that other protocols can be implemented by use of the keyboard to designate which of the two accounting systems should be the active system for the purpose of recharging or other meter system operation.

Whether communication is with the internal smart card chip 8 or the external smart card 10, the communications involves the remote data center interrogating the internal or external accounting system to obtain necessary information such as the status of the funding registers (ascending register and descending register), other inspection information such as evidence of tampering, meter system serial number, internal resettable timer status and resets, and other information depending upon the nature of the particular system. For recharging, the user may enter via the keyboard 62 a desired postage funding refill amount and upon suitable and successful interrogation of the active accounting system, the remote data center provides an encrypted recharging message which is communicated into the accounting system enabling refunding of the accounting system register with added additional postage value. It should be also noted that communications in this matter enables remote inspection of the metering system integrity and to upload or download other information relating to the meter system operation such as monitoring the operability and maintenance from the print module 4. Additionally, if various meter usage information is maintained in the system, this information may be uploaded to the remote data center. Moreover, the remote data center provides a vehicle for downloading additional and new encryption key or keys into the system if so configured and provides the capability for other functionality and services such as meter usage profile. Moreover, at the time of remote meter resetting, a receipt may be caused to be imprinted by the print module as a receipt for the postage accounting system funds refilling. The receipt provides tangible evidence to the user of the date time amount and other pertinent data to the postage accounting system refilling transaction. The receipt may include transaction number and encrypted data such as a cryptographic certificate.

In generating digital tokens or indicia, in certain instances and for certain postal authorities, the digital token is required to contain information concerning the physical location of the electronic postage of the metering system. This may be because of licensing requirements wherein a particular meter is licensed to be operated in a particular location, as for example within a particular zip code area, the originating postal code of the mailer. The metering system 2 accommodates this requirement and enables the utilization of external smart card from originating zip locations other than that the of the license location for the metering system 2. The meter location information may also be important where it is required for use when metered mail must be deposited within the zip code or originating location of the mailer.

In initialization of the meter, that is when the meter is put into service and rendered operable, the location of the metering system 2 is stored in the print module memory 4. This information may be the originating zip code for the mailer or other required location or other information. The information in the flash memory 24 or the smart card chip 18 is employed in imprinting a indicia or digital token on a mail piece by print head 12. It is necessary that the digital token generated either by the external smart card 10 or the internal smart card chip 18 be such that the digital token which contains originating postal code data be such that it is accurate and consistent with the data stored in the flash memory 24 or smart card chip 18 internal memory.

At the time of initialization, the originating location data may be also stored in the internal accounting system 8. When an external accounting system or smart card 10 is connected into the system, and a request for postage is initiated, as part of the authentication process, the communications is established between the external accounting system 10 and the print head smart card chip 18. At that time, a comparison is made between the originating location information stored in the flash memory 24 or smart card chip 18 internal memory and the originating location information stored in the external smart card 10. If there is a correspondence between these two location information storage, the printing of postage and generation of the digital token or indicia may proceed in the normal fashion with any other authentication and processing that may be employed. However, if the location information stored in the flash memory 24 or smart card chip 18 internal memory is inconsistent with the location information stored in the external smart card 10, the system will not operate. At this time, the location information in the external smart card is over written or alternatively may be put in a separate memory location (a travel memory location). Correspondence now exist between the location information stored in the flash memory 24 or smart card chip 18 internal memory and the location information stored in the external smart card 10. Thus, when imprinting postage and generating digital tokens an agreement exists between the data generated on the mail piece from the location information in the flash memory 24 or smart card chip 18 internal memory and from the location information stored in the external smart card 10.

If desired and as part of a routine check, the location information stored in the external smart card can be periodically checked against the location information stored in the flash memory 24 or smart card chip 18. Moreover, location information stored in both the flash memory 24 and the internal accounting system or external accounting system can be checked, if desired, whenever communications are established with the remote accounting center via the modem 28 or RS232 connector 85. Still further, should it be desired, a special purpose external smart card may be connected into the system to interrogate and verify various information stored both in the flash memory 24 and the internal smart card chip 18 or internal accounting system 8.

A secure clock module 48 is connected to the micro controller 26. The secure clock module 48 includes a real time clock 49 which may be a continuous counter that continues operation whether or not the external power is applied to the metering system and an elapsed time counter 51. The elapsed time counter operates only when external system power is applied. Both the real time clock 49 and the elapsed time counter 51 are powered by a internal secure clock module battery/circuitry 53. When external power is removed from the meter system, the count of the elapsed time counter is maintained although it is no longer incremented. On the other hand, the real time clock continues to operate.

The micro controller 26 includes an internal system time counter 33. This may be an internal module within the micro controller. Alternatively, it may be a separate external module connected to the micro controller in a way to operate as a systems time counter. It should be expressly noted the micro controller 26 system time counter 33 may be implemented in software as opposed to an external or internal micro controller module.

The ROM 24 includes a country specific time zone offset 27 and a user settable offsets 29. The utility of these offset will be explained hereinafter in connection with a description of the various flow charts. Time zone offset 27 provides an offset from Greenwich Mean Time. This time is set in the real time clock 49. This offset is specific to the particular location of the metering system in relation to Greenwich England. Additionally, the user settable offset 29 is a user settable limited offset. This allows the meter user to offset the meter clock time to accommodate various issues. For example, the user may offset the clock for daylight savings time. Alternatively, the user may offset the meter system to accommodate different time zones within the particular specific country. The user offset 29 also allows the user to adjust when "midnight" occurs. That is the precise time when the date advances or changes to the next day. This user offset may be limited to a specific number of hours, as for example, plus or minus 12 hours. The amount of the offset and whether it is a positive or negative offset may be determined by various criteria as, for example, the requirements of various postal services. Certain personal services may preclude the ability to move the clock backward.

The ability to have a user settable offset 29, with a particular limitation on the number of hours of offset, provides flexibility in having a settable secure clock while providing the inherent clock security functionality (within the limits of the offset).

A manufacturing facility 82 contains a clock setting application. The manufacturing facility connects to the metering system via a modem 84 or other form of connection such as RS232 port 85.

Either of these connections enable the manufacturing facility to load the Greenwich Mean Time into the real time clock and to load the elapsed time counter as will be explained hereinafter. This manufacturing facility operation may be implemented either during the manufacture of the metering system, when the meter is initialized for service or at any other convenient time in the process.

Figure 2:
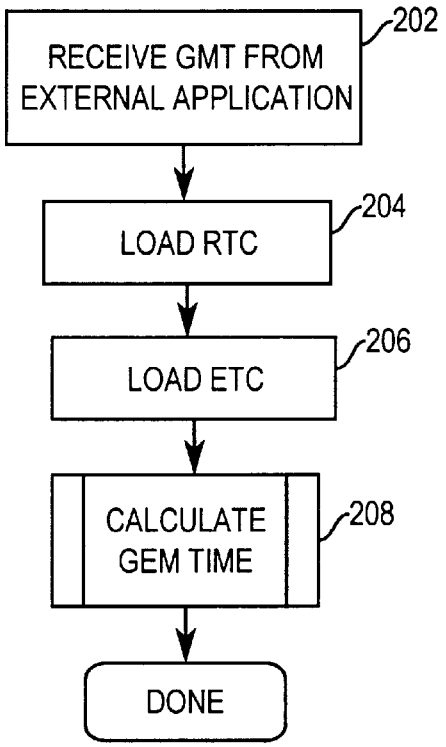
FIG. 2 is a flow chart of a manufacturing time setting routine which may be implemented during the manufacturing of the system or, alternatively, upon initialization of a value metering system.

Reference is now made to FIG. 2. Greenwich Mean Time is received from an external application at 202. The Greenwich Mean Time is loaded into the real time clock 49 at 204 and into the elapsed time counter at 206. This provides an initial synchronization of the real time clock and the elapsed time counter 51 at the time the value metering system is put into operation or the clocks are activated. It should be expressly noted that the elapsed time counter 51 can have a different value loaded into it so long as it has a defined known relationship to the real time clock 204. At this point in time, the real time clock and elapsed time counter 51 may be initialized to operate, if necessary. The GEM time is then calculated at 208. This GEM time is the form of the time used in the value metering system 2 for certain applications when a clock time is needed, as for example, those applications noted above.

Real time clock 49 is loaded with the number of seconds elapsed since Jan. 1, 1970, 00:00 Greenwich Mean Time. GEM time is the number of half days since Jan. 1, 1992 and the number of seconds since the last 12:00 (midnight or noon). During the conversion, the country specific time zone offset 27 and user settable offset 29 is taken into account.

Figure 3:
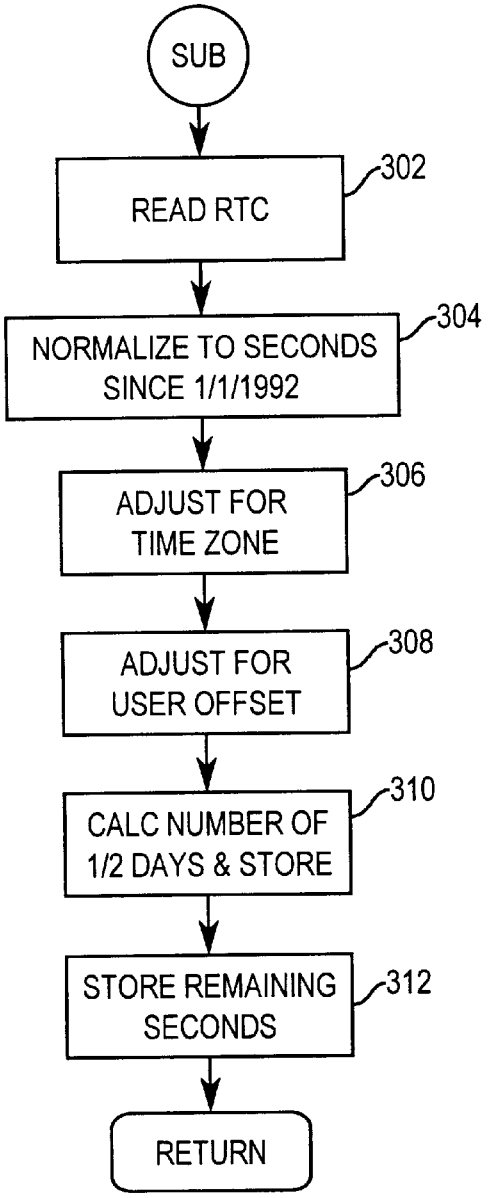
FIG. 3 is a flow chart of a subroutine used to synchronize a real time clock time and a system time clock to enable the clock system to operate as part of a value metering system.

Reference is now made to FIG. 3, the real time clock 49 is read at 302 and normalized to seconds since Jan. 1, 1992 at 304. The time zone is adjusted at 306. This is an adjustment for the time zone offset. User offset is adjusted at 308. The number of half days since Jan. 1, 1992 is calculated at 310 and stored and the number of seconds since noon or midnight remaining after the half day calculation is stored at 312. The data stored at steps 310 and 312 become the basis for the system time counter 33 (clock) in the micro controller 26 and the GEM time used in the system.

It should be expressly noted that the specific details of the calculations such as half days as opposed to quarter days, eighth days or other time unit and the storing of seconds or other time unit since particular time and the unit of remaining time stored are all a matter of design choice. This data stored at 310 and 312 are entered into the system time counter 33 which is part of the micro controller 26.

The system time counter 33 continues during operation of the metering system to count seconds and when a noon or midnight is reached, increment the counting of half days. It should be recognized that the system time counter 33 associated with the micro controller 26 has been converted by means of the secure clock module 48 to have a real time related count or clock data usable by the system. This is because the system time counter 33 is in synchronism with the secure clock module 48. Thus the micro controller 26 which normally does not have secure clock capability through the interaction of the micro controller clock and the secure clock module is made to have a secure real time data usable for various applications as noted above.

Figure 4:
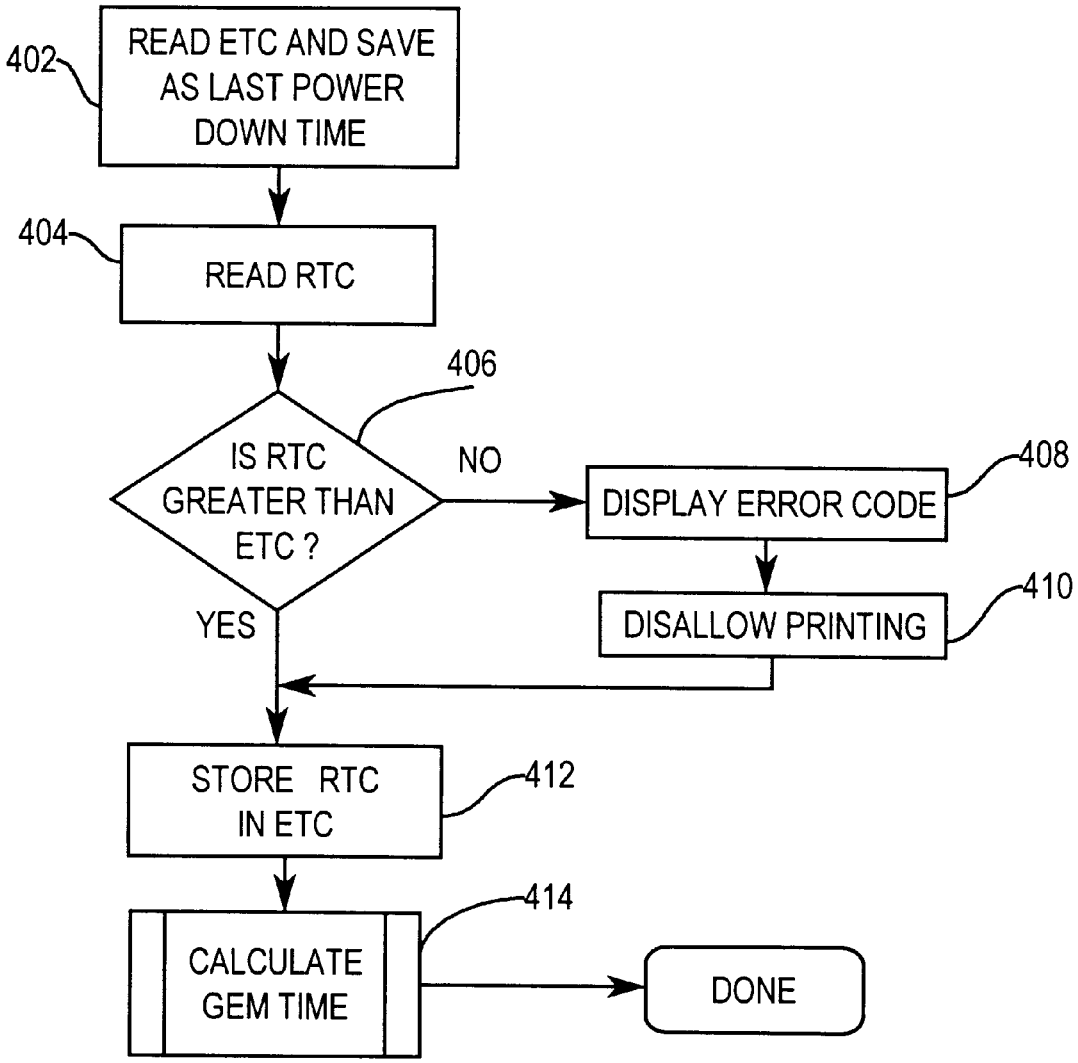
FIG. 4 is a flow chart of the power-up sequence of the value metering system shown in FIG. 1 to provide synchronization during each power-up cycle.

Reference is now made to FIG. 4. During a power up sequence, the elapsed time counter 51 is read and saved as the last power down time at 402. The real time clock 49 time is read at 404. A determination is made at 406 if the real time clock 49 time is greater than the elapsed time counter 51 time, and if it is not, an error code is displayed at 408 and value meter printing or any other selected function is disallowed or disabled at 410.

If, on the other hand, the real time clock 49 time is great than the elapsed time counter 51 time, the real time clock 49 time is stored in the elapsed time counter 51 at 412. This, again, synchronizes the elapsed time counter and the real time clock 49. The GEM time is calculated at 414. This is the call of the subroutine shown in FIG. 3.

Figure 5:
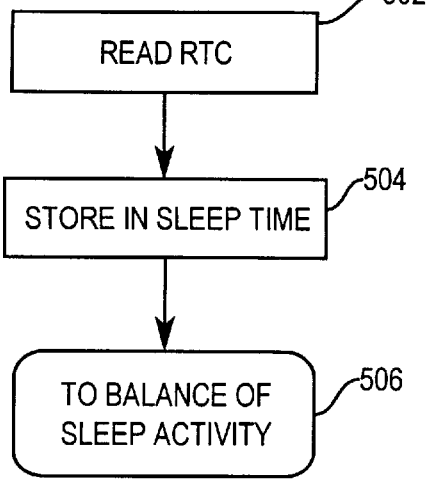
FIG. 5 is a flow chart of the time related clock activity when the value metering system goes into a dormant, "sleep" mode.

Reference is now made to FIG. 5. After the value metering system 2 has been inactive for a predetermined period of time, as for example, ten minutes, the system may be put into an inactive or "sleep" state. At that time, the real time clock 49 is read at 502. The reading which is the sleep time is stored at 504 and the program branches back at 506 to continue the balance of any other sleep activity processing such as turning off displays, power supplies, shift crystal clocks, and the like, associated with shifting to a standby mode.

Figure 6:
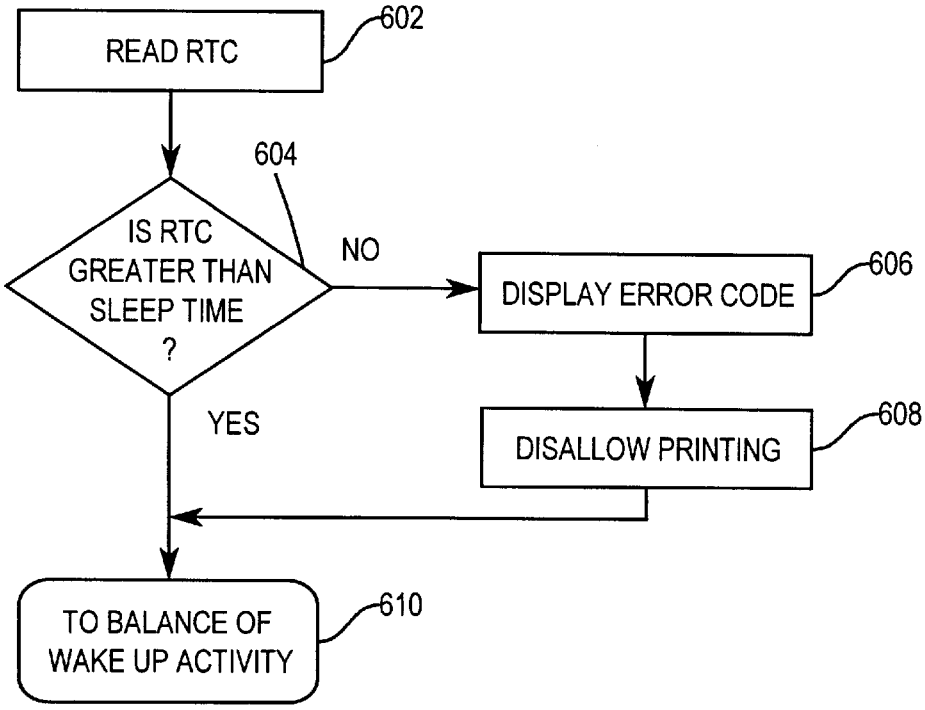
FIG. 6 is a flow chart of the time related activity when the value metering system becomes active, "wake-up mode", after a dormant mode; and, FIG. 7 is a flow chart of certain time related activity, as for example, for ink jet printing time schedule maintenance.

Reference is now made to FIG. 6. When the meter system becomes active, the real time clock is read at 602. A determination is made at 604 if the real time clock 49 time is greater than the sleep time which has been stored at the time the meter became active. If the real time clock time is not greater than the sleep time, an error code is displayed at 606 and printing or other functions are disallowed or disabled at 608. If, on the other hand, the time clock 49 time is greater than the sleep time, the balance of the wakeup activity routine is invoked at 610.

Figure 7:
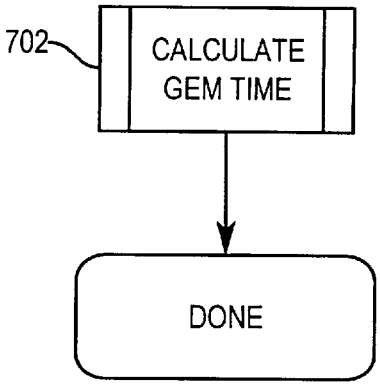

Reference is now made to FIG. 7. The meter is programmed to synchronize at midnight. The GEM time is calculated at 702 for midnight activity. This may be associated with conducting routine maintenance on the device such as purging the ink jet print head, resetting user settable features that may be set during the day such as advance date, advertising slogan, class of mail service, and the like, or other desired functionality. It should be recognized that midnight activity can be invoked at any desired time of the day or multiple times of the day as desired. This feature provides yet further security by re-synchronizing the meter system at predetermined times to insure correct synchronization between the real time clock module 48 and the system time counter 33. Added security is also provided by checking the time relationship of the real time clock 49 and elapsed time counter 51 time in FIGS. 4 and 6 (or any other desired point in the process).

While the present invention has been disclosed and described s with reference to the specific embodiments described herein, it will be apparent, as noted above and from the above itself, that variations and modifications may be made therein. It is, thus, intended in the following claims to cover each variation and modification that falls within the true spirit and scope of the present invention.

What is claimed is:

1. A value metering system employing a system clock time in a first time format, comprising:

a micro controller having a system time counter, said system time counter keeping time in said first time format;

a secure clock module having a real time clock, said real time clock keeping time in a second time format; and means for converting a time of said real time clock from said second time format to said first time format and for storing said converted time of said real time clock into said system time counter.

2. A value metering system according to claim 1, wherein said means for converting takes into account a country specific time zone offset and a user settable offset.

3. A value metering system according to claim 3, said secure clock module further comprising an elapsed time counter, said real time clock incrementing the time kept thereby regardless of whether an external power is supplied to said value metering system and said elapsed time counter incrementing a time kept thereby only when said external power is supplied to said value metering system.

4. A value metering system according to claim 3, wherein the time of said elapsed time counter is retained by said elapsed time counter when said external power is removed and said value metering system is powered down.

5. A value metering system according to claim 4, further comprising means for comparing the time of said elapsed time counter to the time of said real time clock immediately after said external power is reapplied to the value metering system and means for generating an error code and inhibiting operation of said value metering system if the time of said elapsed time counter is greater than the time of said real time clock.

6. A value metering system according to claim 5, further comprising means for storing the time kept by said real time clock in said elapsed time counter after said comparison.

7. A method of providing a system clock time for a value metering system, said system clock time being kept in a first time format by a system time counter of a micro controller, said method comprising the steps of:

providing a secure clock module having a real time clock, said real time clock keeping time in a second time format;

converting a time of said real time clock from said second time format to said first time format; and storing said converted time of said real time clock into said system time counter.

8. A method according to claim 7, wherein said converting step takes into account a country specific time zone offset and a user settable offset.

9. A method according to claim 7, said secure clock module having an elapsed time counter, said real time clock incrementing the time kept thereby when said value metering system is powered down and said elapsed time counter not incrementing a time kept thereby when said value metering system is powered down, said method further comprising the steps of:

comparing the time of said real time clock to the time of said elapsed time counter when said value metering system is powered up; and generating an error code and inhibiting operation of said value metering system if the time of said elapsed time counter is greater than the time of said real time clock.

10. A method according to claim 9, further comprising the step of storing the time of said real time clock into said elapsed time counter after said comparing step.

* * * * *